US005869925A

United States Patent [19]

Kim et al.

[11] Patent Number: 5,869,925

[45] Date of Patent: Feb. 9, 1999

[54] ELECTRON GUN WITH FOCUSING ELECTRODES

[75] Inventors: Hyun Cheol Kim; Won Hyun Kim; Sung Gi An, all of Kyungsangbuk-do; Hi Won Yoon, Daekukwangyeok-si; Sung Ho Cho, Kyungsangbuk-do, all of Rep. of Korea

[73] Assignee: LG Electronics, Inc., Rep. of Korea

[21] Appl. No.: 833,652

[22] Filed: Apr. 8, 1997

[30] Foreign Application Priority Data

Oct. 21, 1996 [KR] Rep. of Korea ..... 47103/1996

[51] Int. Cl.[6] ..... H01J 29/51

[52] U.S. Cl. ..... 313/460; 313/412; 315/382.1; 315/368.15

[58] Field of Search ..... 313/412, 413, 313/414, 437, 432, 436, 448, 460, 449; 315/382, 382.1, 14, 15, 368.15

[56] References Cited

U.S. PATENT DOCUMENTS 4,599,534 7/1986 Shirai et al. ..... 313/414
4,886,999 12/1989 Yamane et al. ..... 313/414
5,719,475 2/1998 Shishido ..... 313/449

OTHER PUBLICATIONS

"14:3: New Approach to Design Dynamic Quadrupole Inline Gun for CRT", B.K. Song, H.T. Kim S.K., Euro Display (Oct.) '96, pp. 500–503 + Euro Display Itinerary Proceedings of the 16th Intern'tl Display Research Conference.

*Primary Examiner*—Frank G. Font
*Assistant Examiner*—Michael Day
*Attorney, Agent, or Firm*—Fish & Richardson PC

[57] ABSTRACT

A Focusing electrode in an electron gun for a color cathode ray tube provides a higher degree of freedom in electron gun design and reduces errors during assembly of the electron gun. A first focusing electrode that receives a constant voltage has vertically elongated electron beam pass-through holes formed in it. A second focusing electrode that receives a dynamic voltage has electron beam pass-through holes that include a pair of burring parts formed on their upper and lower edges. The burring parts are disposed in each of the vertically elongated electron beam pass-through holes in the first focusing electrode without changing a horizontal diameter of the electron beam pass-through holes in the first focusing electrode.

5 Claims, 7 Drawing Sheets

ELECTRON GUN WITH FOCUSING ELECTRODES

BACKGROUND OF THE INVENTION

1. Field of the invention

The present invention relates to an electron gun for a color TV or industrial high definition cathode ray tube, and more particularly, to a focusing electrode in an electron gun for a color cathode ray tube, which can provide more freedom in electron gun design and reduce errors during the assembly of the electron gun.

2. Discussion of the Related Art

The electron gun in a color cathode ray tube focuses three electron beams emitted from cathodes onto a surface of red, green and blue fluorescent materials coated inside of a cathode ray tube so that each of the fluorescent materials reacts to the electron beams to luminesce, to form a pixel on a screen.

FIG. 1 illustrates a sectional view of a general color cathode ray tube.

Referring to FIG. 1, the color cathode ray tube 4 includes an in-line type electron gun 2, deflection yokes 3 for deflecting electron beams 1 in the up and down and the left and right directions and a screen 5 for forming pixels in reaction to the electron beams 1. The screen includes an inside surface 6 coated with fluorescent materials, a funnel 7 that converges from the rim of the screen 5 toward the rear of the tube 4 and a neck part 8 formed at an end of the funnel 7. The in-line type electron gun 2 is mounted inside of the neck part 8 and the deflection yokes 3 are mounted outside of the neck part 8. A shadow mask 9, having a plurality of electron beam pass-through holes 91 for allowing selective collision of the electron beams 1 shot from the in-line type electron gun onto the fluorescent surface 6, is provided between the fluorescent surface 6 and the electron gun 2.

FIG. 2 illustrates a cross sectional view of the in-line type electron gun shown in FIG. 1, FIG. 3A illustrates examples of distortion of electron beam spots on a screen caused by a non-uniform magnetic field formed by deflection yokes, and FIG. 3B illustrates examples of correction of the electron beam spots shown in FIG. 3B by a dynamic quadrupole lens formed by a focusing electrode having burring parts.

Referring to FIG. 2, the in-line type electron gun 2 generally includes a tripolar part 21 and a main focal electrostatic lens part 22. The tripolar part 21 includes, cathodes 23 for emitting thermal electrons following heating by heaters 231 provided therein, a controlling electrode 24 for controlling the thermal electrons, and an accelerating electrode 25 for accelerating the thermal electrons. The main focal electrostatic lens part 22 disposed next to the tripolar part 21 includes a focusing lens 26 and an anode 27. Predetermined voltages are applied to the electrodes; in general, the controlling electrode 24 is grounded, the accelerating electrode 25 receives of a low voltage of 500~1000 V, the anode 27 receives of a high voltage of 25~35 Kv, and the focusing electrode 26 is applied of an intermediate voltage, a voltage corresponding to 20~30% of the voltage applied to the anode 27.

The operation of the in-line type electron gun for a color cathode ray tube having the aforementioned system will be explained.

Upon application of predetermined voltages to the electrodes, voltage differences are formed between the electrodes so that the electron beams emitted from the cathodes are controlled and accelerated to a predetermined intensities by the controlling electrode 24 and the accelerating electrode 25. A voltage difference formed between the focusing lens 26 and the anode 27 forms equipotential planes, which, collectively, act as the main focal electrostatic lens. Accordingly, the electron beams, accelerated by the voltage difference of the anode 27 toward the screen, are focused by the main focal electrostatic lens, pass through the electron beam pass-through hole in the shadow mask 9, and collide on the fluorescent surface 6 on the central part of the screen, to form a pixel. While the focusing of the electron beams 1 onto the central part of the screen is made possible by the main focal electrostatic lens, the deflection of the electron beams 1 by the deflection yokes 3 is required for the sequential scanning of the electron beams onto each region of the screen. There is mismatch of the convergence in the deflection of the electron beams by means of the deflection yokes due to the in-line configuration of the electron gun and the difference of curvatures in the screen. The mismatch of the convergence can be corrected by providing a self convergence of the beams using deflection yokes which can form a non-uniform magnetic field. However, the application of the non-uniform magnetic field causes a problem in which the electron beam forms a horizontally elongated spot with a haze, which is a thin dispersion of an image, on the upper and lower sides of the spot, as shown in FIG. 3A. In order to solve the problem, a dynamic quadrupole lens which is operative synchronous to a deflection synchronizing signal has been used for correction of an astigmatism when the electron beam is deflected toward periphery of the screen.

FIG. 4A illustrates a perspective view of a two-part focusing electrode assembly for a conventional in-line type electron gun, which can form the dynamic quadrupole lens.

Referring to FIG. 4A, the focusing electrode 26 includes a first focusing electrode 261 to which a constant voltage is applied, a second focusing electrode 262 arranged next to the first focusing lens to which a dynamic voltage is applied to make a voltage difference of about 300 V~1000 V depending on the extent of deflection of the electron beam, oppositely faced surfaces 265 and 266 of the first and second focusing electrodes 261 and 262 at one ends thereof each having first and second electron beam pass-through holes (263*c*, 263*s* and 264*c*, 264*s*), and a pair of burring parts 267*c* and 267*s* at upper and lower portions of the circumference of each of the electron beam pass-through holes 264*c* and 264*s* in the second focusing electrode. When the first and second focusing electrodes are in place, each of the burring parts 267*c* and 267*s* are inserted in the electron beam pass-through holes 263*c* and 263*s* in the first focusing electrode.

As explained, a dynamic quadrupole lens is formed by the voltage difference between the first focusing electrode 261 to which a low static voltage is applied and the second focusing electrode 262 to which a high dynamic voltage is applied. Particularly, due to the burring parts 267*c* and 267*s* provided on upper and lower parts of the electron beam pass-through holes 263*c* and 264*s* in the second focusing electrode 262 which diverges the electron beam, the diverging power acts stronger than the converging power from the first focusing electrode 261 which converges the electron beam to correct the electron beam into a vertically elongated form. Accordingly, the horizontally elongated form of astigmatism of the electron beam caused by the deflection yokes can be corrected as shown in FIG. 3B.

However, despite the aforementioned advantage of astigmatism correction capability of the conventional two-part focusing electrode in application to an electron gun, there have been problems which actually impede application of the focusing electrode to the in-line type electron gun.

First, the voltage difference of about 300 V~1000 V between the voltages applied to the first and second focusing electrodes 261 and 262 might damage parts of the electron gun in case of the occurrence of discharge between them, which causes a problem of shortening the life time of the cathode ray tube. In order to prevent such an occurrence of discharge, as shown in FIG. 4B, the in-line type electron gun under production currently has been designed to have a pitch S, which is a distance between adjacent axes of the electron beam pass-through holes 263*c*, 263*s* and 264*c*, 264*s*, of 5.5 mm, a diameter D2 of each of the electron beam pass-through holes 264*c* and 264*s* in the second focusing electrode of 4.0 mm, a thickness t of each of the parts of the electron gun of 0.33 mm, a bridge width, which is a distance between adjacent electron beam pass-through holes 263*c* and 263*s* in the first focusing electrode of b mm, and a gap between the electron beam pass-through holes 263*c* and 263*s* in the first focusing electrode and the burring parts 267 limited to (a>0.2) which does not cause discharge. However, if an electron gun is designed to have the aforementioned dimensions, since the diameter D1 of each of the electron beam pass-through holes 263*c* and 263*s* in the first focusing electrode should be 5.06=(4 mm+0.33 mm×2+0.2 mm×2) at the minimum, only 0.46 mm remains for the bridge width b. This causes deformation of the bridge b from the heat applied to the bridge during fusion of bead glass(not shown) in an assembly of the electron gun. Even in the case when a burring part 268*c* and 268*s* (shown in dotted lines in FIG. 4B), which is inserted into the second focusing electrode, is provided around each of the electron beam pass-through holes 263*c* and 263*s* in the first focusing electrode for prevention of the deformation of the bridges, there has been a conflict that a 0.66 mm burring part is needed on the bridge of 0.46 mm width, because two burring parts should be formed between two adjacent electron beam pass-through holes 263*c* and 263*s* in the first focusing electrode, i.e., on both rims of the bridge b(dotted lines in FIG. 4B). Thus, formation of the burring parts 268 at the electron beam pass-through holes 263*c* and 263*s* in the first focusing electrode is not possible.

Secondly, in assembly of the electron gun, after mandrels are inserted from the control electrode up to the anode through each of the electron beam pass-through holes in each of the electrodes to fix the electrodes thereto, preventing the electrodes from shaking, one pair of bead glasses are fusion welded on both sides of the electrodes to complete assembly of the electron gun. However, since the mandrel has an outside diameter tightly fit to the inside diameter of the second focusing electrodes 264*c* and 264*s*, and the diameter of the electron beam pass-through holes 263*c* and 263*s* in the first focusing electrode is greater than the electron beam pass-through holes 264*c* and 264*s* in the second focusing electrode, the first focusing electrodes could not be fixed to the mandrel firmly, resulting in movement of the first focusing electrode 261 during the bead glass fusion welding, which causes misassembly of the first focusing electrode 261 so that the electron gun can not provide its designed performance.

Thirdly, the magnetic field from the dynamic quadrupole lens weakens a focusing power of the main focal electrostatic lens to the outer electron beams, which deteriorates the resolution.

SUMMARY OF THE INVENTION

Accordingly, the present invention is directed to a focusing electrode in an electron gun for a color cathode ray tube that substantially obviates one or more of the problems due to limitations and disadvantages of the related art.

An object of the present invention is to provide a focusing electrode in an electron gun for a color cathode ray tube, which allows insertion of the upper and lower burring parts into each of the electron beam pass-through holes in the first focusing electrode without the reduction of the bridge width.

Another object of the present invention is to provide a focusing electrode in an electron gun for a color cathode ray tube, in which the first focusing electrode can be fixed in place by the mandrels that fix the second focusing electrode.

Another object of the present invention is to provide a focusing electrode in an electron gun for a color cathode ray tube, which can prevent the weakening of the focusing power of the main focal electrostatic lens to the outer electron beams caused by the dynamic quadrupole lens formed between the first and second electrodes.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the focusing electrode in an electron gun for a color cathode ray tube includes a first focusing electrode for receiving a constant voltage, the first focusing electrode having vertically elongated electron beam pass-through holes formed therein, and a second focusing electrode for receiving a dynamic voltage, the second focusing electrode having electron beam pass-through holes each with a pair of burring parts formed on upper and lower edges thereof for being disposed in each of the vertically elongated electron beam pass-through holes in the first focusing electrode, whereby the pair of burring parts can be disposed in each of the vertically elongated electron beam pass-through holes in the first focusing electrode without change of a horizontal diameter of the electron beam pass-through holes in the first focusing electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
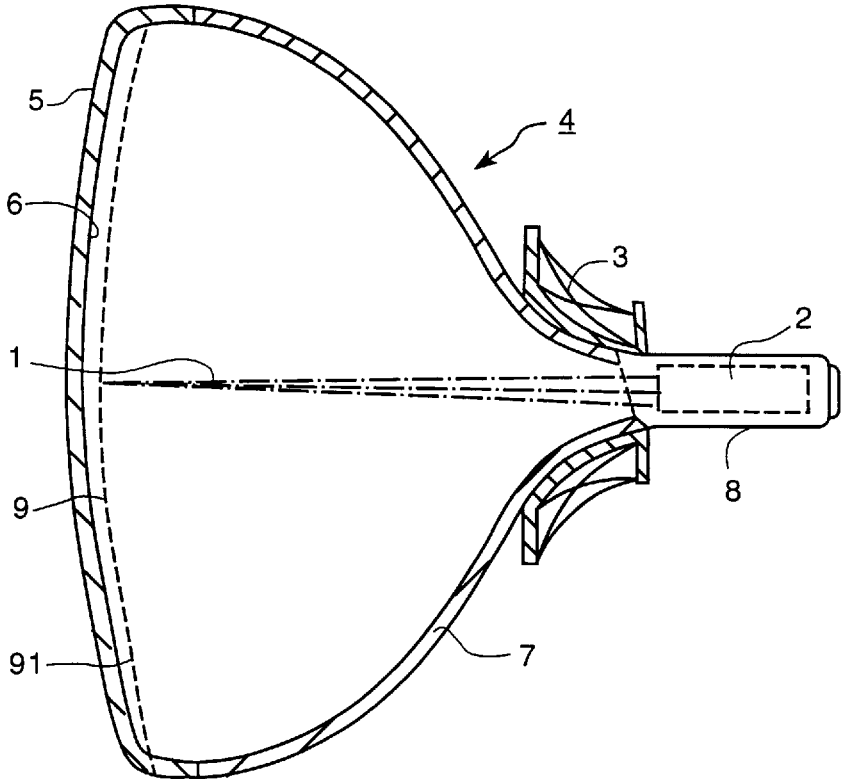
FIG. 1 (PRIOR ART)
FIG. 1 illustrates a sectional view of a general color cathode ray tube.
Figure 2:
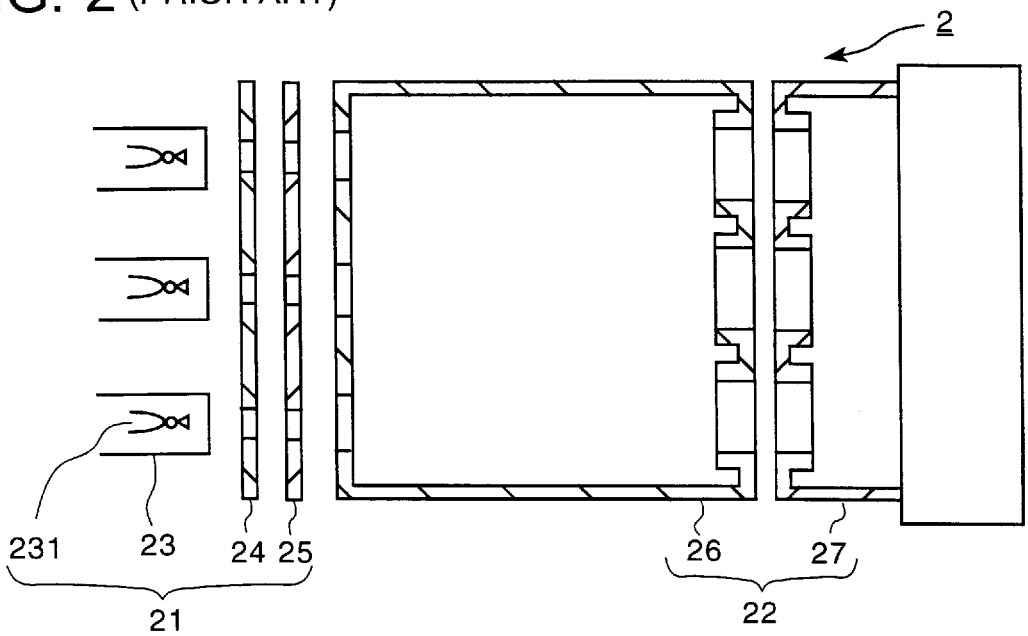
FIG. 2 (PRIOR ART)
FIG. 2 illustrates a cross sectional view of the in-line type electron gun shown in FIG. 1.
Figure 3A:
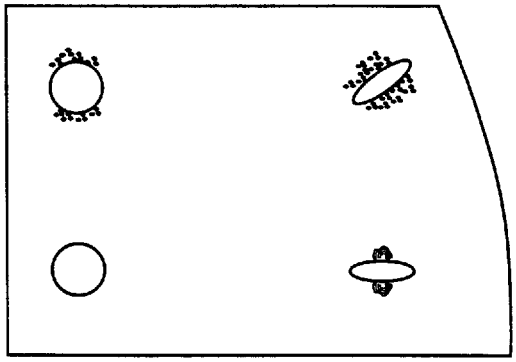
FIG. 3A (PRIOR ART)
FIG. 3A illustrates examples of distortion of electron beam spots on a screen caused by a non-uniform magnetic field formed by deflection yokes.
Figure 3B:
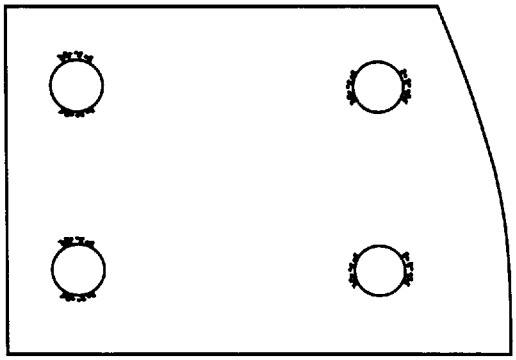
FIG. 3B (PRIOR ART)
FIG. 3B illustrates examples of correction of the electron beam spots shown in FIG. 3A by a dynamic quadrupole lens formed by a focusing electrode having burring parts.
Figure 4A:
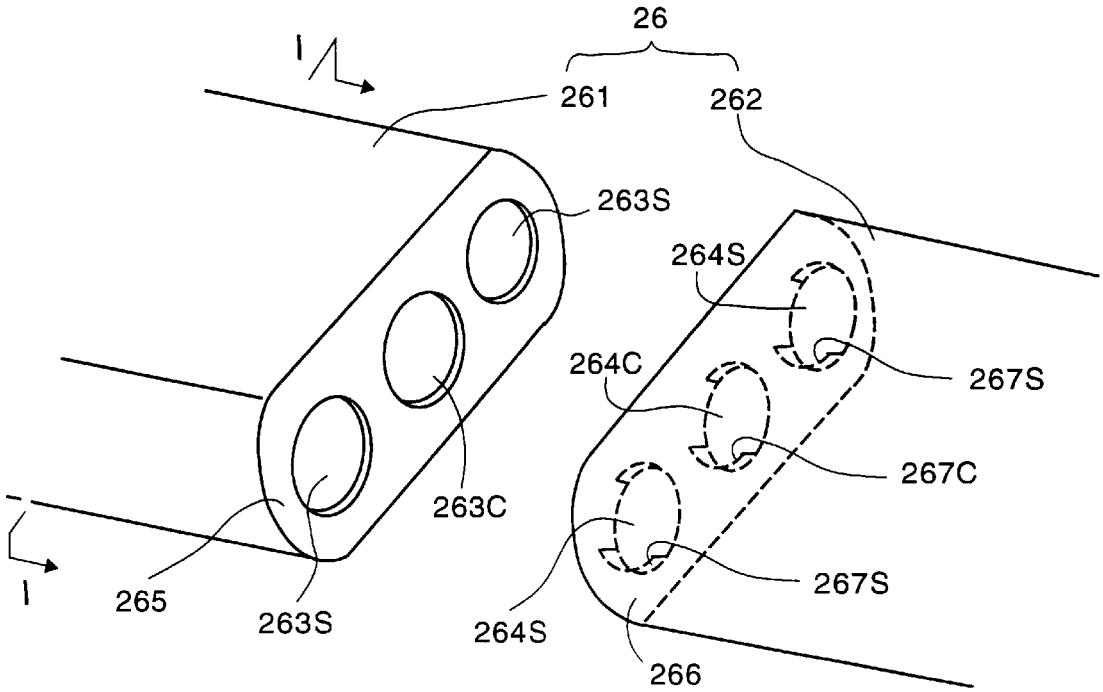
FIG. 4A (PRIOR ART)
FIG. 4A illustrates a perspective view of a focusing electrode in a conventional in-line type electron gun.
Figure 4B:
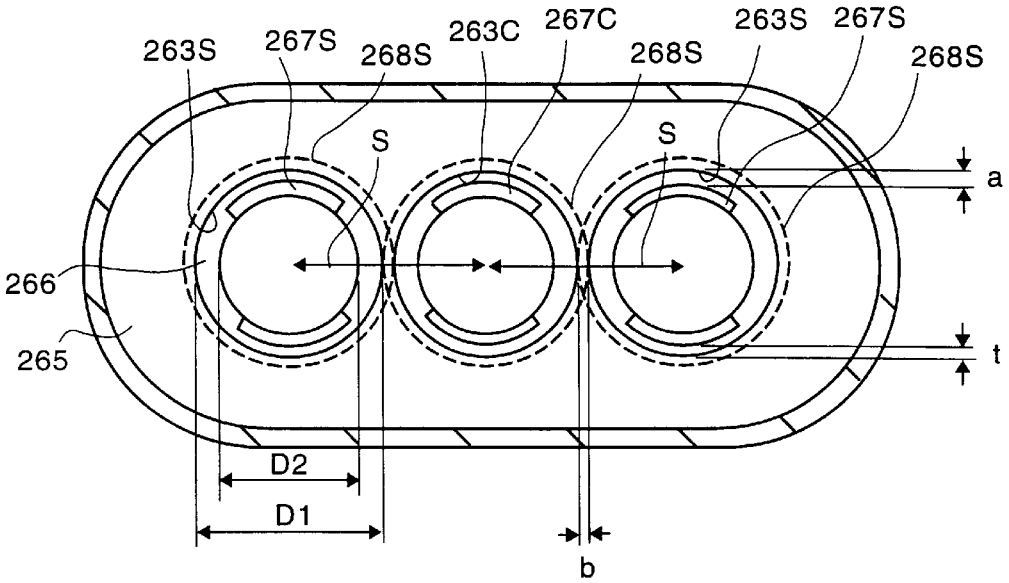
FIG. 4B (PRIOR ART)
FIG. 4B illustrates a sectional view of the focusing electrode across line I—I shown in FIG. 4A.
Figure 5A:
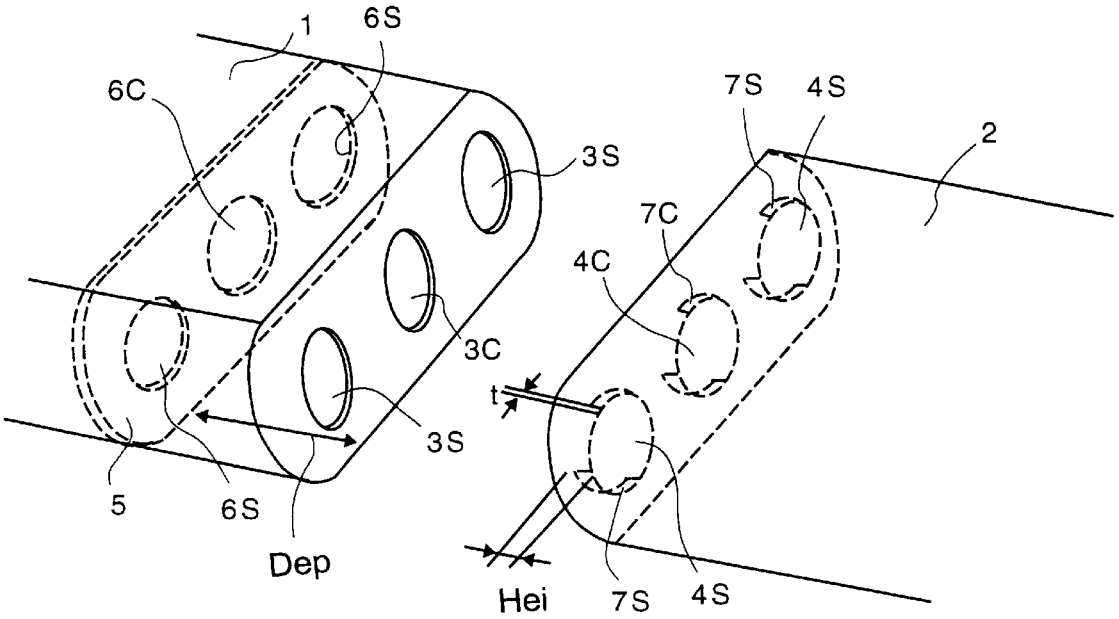
FIG. 5A illustrates a perspective view of a focusing electrode in accordance with a preferred embodiment of the present invention.
Figure 5B:
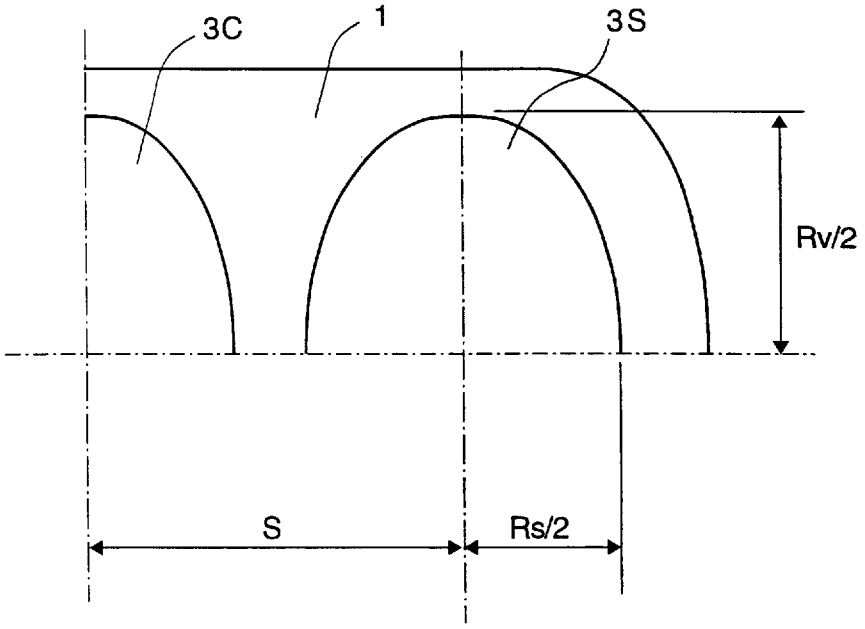
FIG. 5B illustrates a front view of a part of a first focusing electrode shown in FIG. 5A.
Figure 5C:
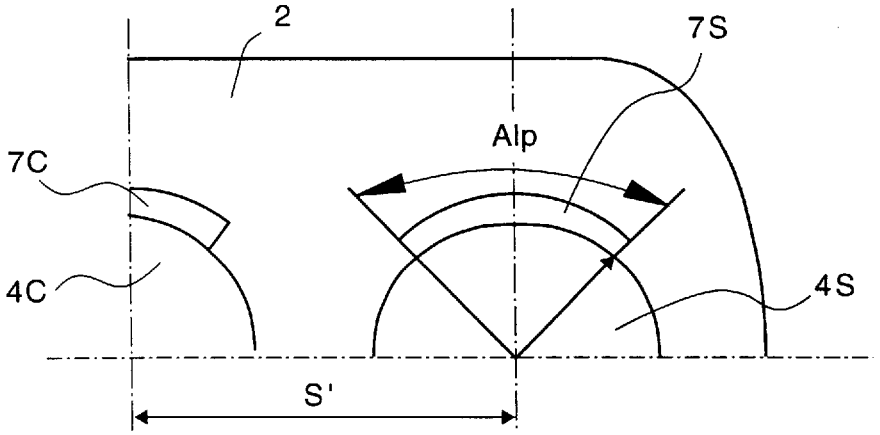
FIG. 5C illustrates a front view of a part of a second focusing electrode shown in FIG. 5A, FIGS. 6A, 6B and 6C illustrate other embodiment forms of electron beam pass-through holes in the first focusing electrode in accordance with the present invention; and, FIG. 7 illustrates a graph showing extents of deflections of an electron beam depending on dimensions of parts in the focusing electrode in accordance with the present invention.

FIG. 5A illustrates a perspective view of a focusing electrode in accordance with a preferred embodiment of the present invention, FIG. 5B illustrates a front view of a part of a first focusing electrode shown in FIG. 5A, and FIG. 5C illustrates a front view of a part of a second focusing electrode shown in FIG. 5A.

Referring to FIG. 5A, the focusing electrode in an electron gun for a color cathode ray tube in accordance with a preferred embodiment of the present invention includes a first focusing electrode 1 having electron beam pass-through holes 3*c* and 3*s* for receiving a constant voltage, a second focusing electrode 2 having electron beam pass-through holes 4*c* and 4*s* each with upper and lower burring parts 7*c* and 7*s* for receiving a dynamic voltage according to an extent of deflection of the electron beam by deflection yokes.

Figure 6A:
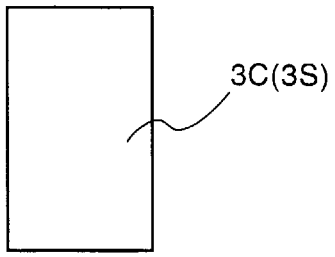
Figure 6B:
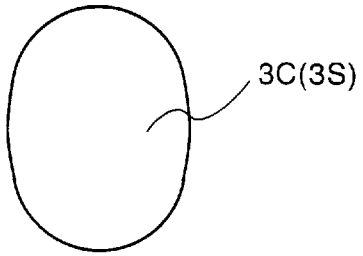
Figure 6C:
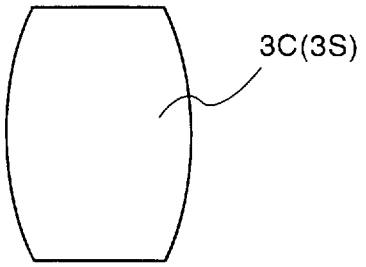

Each of the electron beam pass-through holes 3*c* and 3*s* in the first focusing electrode is formed in a vertically elongated form so as to accept the burring parts 7*c* and 7*s*. That is, as shown in FIG. 5B, each of the electron beam pass-through holes 3*c* and 3*s* is formed in a vertically elongated form which has a vertical radius Rv greater than a horizontal radius Rs, preferably to a size enough to prevent occurrence of discharge between the burring parts 7*c* and 7*s* and the electron beam pass-through holes 3*c* and 3*s* in the first focusing electrode. As shown in FIGS. 6A, 6B and 6C, the vertically elongated form of each of the electron beam pass-through holes 3*c* and 3*s* may be a polygon with straight sides, oval with curved sides, or a form with straight sides and curved sides.

Further, the focusing electrode of the present invention may be provided with an internal electrodes arranged inside of the first focusing electrode 1 having electron beam pass-through holes 6*c* and 6*s* each disposed on the same axis as pass-through holes 3*c* and 3*s*, and having the same diameter with the diameter of the electron beam pass-through holes 4*c* and 4*s* in the second focusing electrode 2 for fixing the fixing the first focusing electrode 1 as well as the second focusing electrode with the same mandrels.

Since the magnetic field from the dynamic quadrupole lens weakens the main focal electrostatic lens component, with subsequent drop of the focusing power of the main focal electrostatic lens to the outer electron beams, as shown in FIGS. 5B and 5C, a distance S from the center electron beam pass-through hole 3*c* to each of the side electron beam pass-through holes 3*s* in the first focusing electrode is preferably formed smaller than a distance S' from the center electron beam pass-through hole 4*c* to each of the side electron beam pass-through holes 4*s* in the second focusing electrode, to correct the drop of the focusing power of the main focal electrostatic lens to the side beams. This leads an outer side of each of the side electron beam pass-through holes 3*s* in the first focusing electrode to come closer to the inserted burring parts 7*s*, so that the quadrupole lens formed between the burring parts 7*c* and 7*s*, the electron beam pass-through holes 3*c* and 3*s* in the first focusing electrode and the electron beam pass-through holes 6*c* and 6*s* in the internal electrode, on application of dynamic voltage to the second focusing electrode 2, strengthens the focusing power to the side electron beams, compensating for the drop of focusing power of the main focal electrostatic lens.

In the meantime, design parameters for each of the parts of the focusing electrode of the present invention are obtainable by means of computer three dimensional simulations, of which steps will be explained.

First, under the condition that an astigmation correction means is not in operation, focus voltages at the center, top, each edge and each corner of the screen are measured. Upon measurement of the focus voltages, it can be determined that there is almost no variation of the focus voltage in a horizontal direction, and there is exponential variation in a vertical direction. Accordingly, astigmatisms in the horizontal direction are excluded, and the values obtained by subtracting a center focus voltage value from the focus voltage values at each position are those astigmatism components which should be finally improved. The astigmatism component can be classified into components from a focal distance, a diverging angle and a radius of the electron beam. In order to correct those astigmatism components, computer simulations are carried out to adjust a gap between the first and second electrodes Gap, a depth of the internal electrode Dep, and a height Hei, thickness t and angle Alp of the burring part to obtain an astigmatism correction value equal to the astigmatism caused by the deflection yokes, thereby approximate parameters for designing a quadrupole lens can be obtained.

Figure 7:
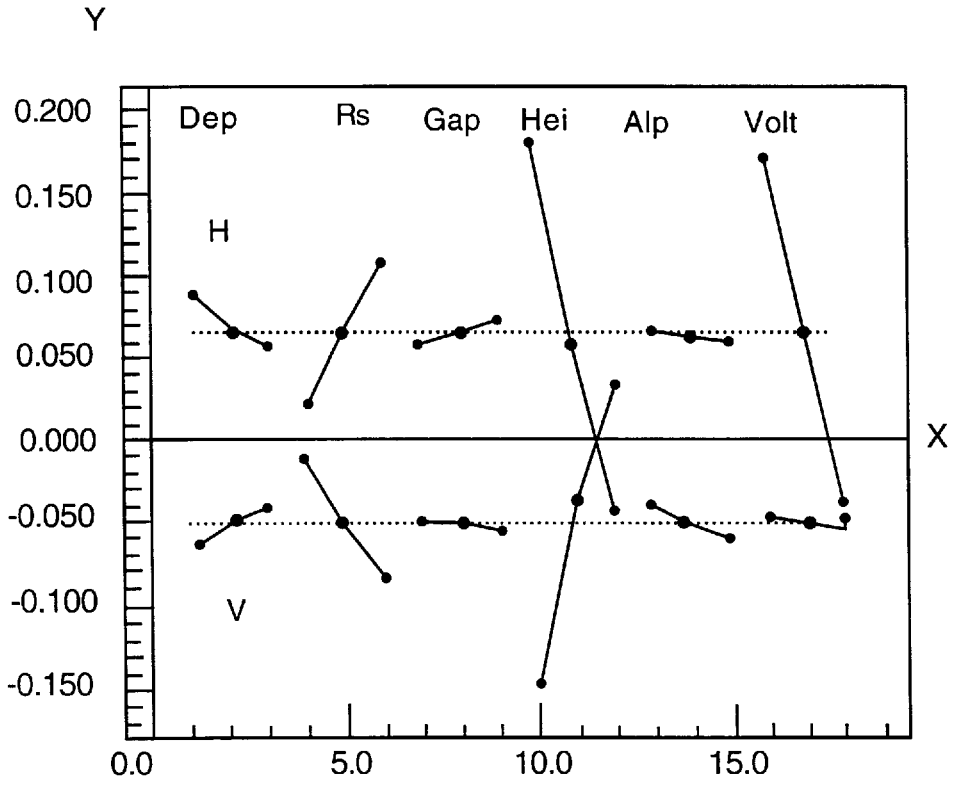

FIG. 7 illustrates a graph showing extents of deflections of an electron beam depending on dimensions of parts in the focusing electrode in accordance with the present invention.

In FIG. 7, one increment on the X-axis represents a dimensional change by 0.1 mm of the parts in the electrode, and one increment on the Y-axis represents a change in the focal distance of which upper side of X-axis represents focusing characteristics of the electron beam in a horizontal direction and lower side of X-axis represents focusing characteristics of the electron beam in a vertical direction, of which results are shown in TABLE 1 shown below.

TABLE 1

| | Dep | Rs | Hei | Alp | Gap |
|---|---|---|---|---|---|
| Horz focusing power | diverge | diverge | converge | converge | diverge |
| Vert focusing power | converge | converge | diverge | diverge | converge |

The focusing power is particularly sensitive to changes of the height of the burring parts 7*c* and 7*s* and an X-axis change of the horizontal diameter Rs of the electron beam pass-through holes 3*c* and 3*s* in the first focusing electrode; the smaller the horizontal diameter, the stronger the power of the quadrupole lens. This is the reason why the distance S from the center electron beam pass-through hole 3*c* to each of the side electron beam pass-through holes 3*s* in the first focusing electrode is formed smaller than the distance S' from the center electron beam pass-through hole 4*c* to each of the side electron beam pass-through holes 4*s* in the second focusing electrode, for correcting the drop of the focusing power of the main focal electrostatic lens to the side beams. As the divergence and convergence according to changes of the horizontal diameter Rs and the height Hei of the burring part tend to offset each other, the focal distance can be simply changed only with the change of the depth of the internal electrode without any particular change in the horizontal radius Rs or the height Hei of the burring part.

Approximate design parameters for the focusing electrode of the present invention obtained based on such result are as follows.

The first focusing electrode with elongated holes

Horizontal diameter Rs: 4.6 mm

Vertical diameter Rv: 7.0 mm

Thickness t: 0.4 mm

Center distance S: 5.46 mm

Burring part on the second focusing electrode

Height Hei: 0.5 mm

Angle Alp: 60°

Thickness t: 0.4 mm

Depth of the internal electrode in the first focusing electrode: 3.5 mm

A distance between the first and second focusing electrodes: 0.5 mm

As has been explained, the formation of each of the electron beam pass-through holes elongated only in upper and lower portions into an elongated form permits the bridge to be wider.

The provision of the internal electrode in the first focusing electrode having electron beam pass-through holes, each of which can be tightly fitted on a mandrel, can prevent shaking of the first focusing during beading of the electron gun, thereby fabrication of a precise electron gun is facilitated.

By changing the depth of the internal electrode arranged in the first focusing electrode, a capacity change of an electron gun can be tolerated to a certain extent only limited to the focusing electrode of the present invention without any change of the design even if particulars of the electron gun are changed depending on a size of a cathode ray tube.

It will be apparent to those skilled in the art that various modifications and variations can be made in the focusing electrode in an electron gun for a color cathode ray tube of the present invention without departing from the spirit or scope of the invention. Thus, it is intended that the present invention cover the modifications and variations of this invention provided they come within the scope of the appended claims and their equivalents.

What is claimed is:

1. Focusing electrodes in an electron gun for a color cathode ray tube, the focusing electrodes comprising:

a first focusing electrode for receiving a constant voltage, the first focusing electrode having vertically elongated electron beam pass-through holes, a second focusing electrode for receiving a dynamic voltage, the second focusing electrode having electron beam pass-through holes each with a pair of burring parts formed on upper and lower edges thereof, the second focusing electrode being positioned so that the burring parts are disposed in the vertically elongated electron beam pass-through holes in the first focusing electrode; and an inner electrode having electron beam pass-through holes and disposed in the first electrode.

2. Focusing electrodes as claimed in claim 1, wherein a center distance between adjacent electron beam pass-through holes in the first focusing electrode is smaller than a center distance between adjacent electron beam pass-through holes in the second focusing electrode.

3. Focusing electrodes as claimed in claim 1, wherein each of the electron beam pass-through holes in the first focusing electrode is formed with curved side lines.

4. Focusing electrodes as claimed in claim 1, wherein each of the electron beam pass-through holes in the first focusing electrode is polygonal.

5. Focusing electrodes as claimed in claim 1, wherein portions of each of the electron beam pass-through holes in the first focusing electrode are formed with curved side lines.

* * * * *